United States Patent [19]

Groza et al.

[11] 4,240,246

[45] Dec. 23, 1980

[54] WIRE STRANDING MACHINE

[76] Inventors: Viktor F. Groza, ulitsa Darvina, 7, kv. 12; Jury N. Sharapov, ulitsa Akademika Pavlova, 148a, kv. 16; Nikolai P. Shtykh, ulitsa 3 Internatsionala, 17, kv. 56, all of Kharkov; Khristofor S. Shakhpazov, prospekt Mira, 188, kv. 30, Moscow; Ivan N. Nedovizy, ulitsa Moskovskaya, 37, kv. 49, Magnitogorsk; Sergei F. Korovainy, ulitsa Vokzalnaya, 70, kv. 50; Valentin D. Judin, ulitsa Vokzalnaya, 72, kv. 50, both of Khartsyzsk; Nikolai P. Chernenko, ulitsa Pushkinskaya, 18, kv. 4, Orel; Vitaly S. Starchenko, Moskovskoe shosse, 157, kv. 12, Orel; Georgy A. Kalosha, Moskovskoe shosse, 161, kv. 118, Orel; Aza A. Tsybulina, ulitsa Moskovskaya, 121a, kv. 28, Magnitogorsk; Nikolai I. Drozdov, prospekt Vernadskogo, 82, kv. 1517, Moscow, all of U.S.S.R.

[21] Appl. No.: 71,856

[22] Filed: Sep. 4, 1979

[30] Foreign Application Priority Data

Sep. 20, 1978 [SU] U.S.S.R. ..... 2660351

[51] Int. Cl.[3] ..... D07B 3/12; D07B 7/02

[52] U.S. Cl. ..... 57/58.3; 57/58.34; 57/58.76

[58] Field of Search ..... 57/58.3, 58.32, 58.34, 57/58.36, 58.38, 58.72, 58.76

[56] References Cited

U.S. PATENT DOCUMENTS

| | | | |
|---|---|---|---|
| 2,499,245 | 2/1950 | Harman | 57/58.36 X |
| 2,567,329 | 9/1951 | Frazier | 57/58.34 X |
| 2,690,642 | 10/1954 | Van Hook | 57/58.34 |
| 3,095,686 | 7/1963 | Steinlein | 57/58.3 |
| 3,636,692 | 1/1972 | Berges | 57/58.3 |
| 3,785,139 | 1/1974 | Groza et al. | 57/58.76 X |

*Primary Examiner*—Donald Watkins
*Attorney, Agent, or Firm*—Lackenbach, Lilling & Siegel

[57] ABSTRACT

A wire stranding machine intended for the manufacture of metal cord strands comprises a vertical rotor made in the form of a shaft with casings secured on the ends thereof and internally accommodating reel holders. Parts are provided in the casings for installing reels into the reel holders and guide dies for passing wires. On a portion between the casings the rotor shaft is provided with through ducts. Adjacent the reel holders are electromagnets fixedly mounted for restraining the reel holders from rotating together with the shaft. This makes it possible to decrease the mass and reduce the dimensions of the machine, and to simplify the servicing thereof.

2 Claims, 2 Drawing Figures

WIRE STRANDING MACHINE

BACKGROUND OF THE INVENTION

The present invention relates to rope production and more particularly, to wire stranding machines intended for the manufacture of metal cord strands and it may also be conveniently used for the production of steel ropes.

Wire stranding machines and rope making machines of diversified designs are presently well known in the art. However, these machines are large in dimensions and complicated in operation.

DESCRIPTION OF THE PRIOR ART

There is also known a machine intended for the manufacture of strands or ropes (cf. U.S. Pat. No. 3,785,139, Cl.DO7b3/12) which comprises: a hollow rotor made of a non-magnetic material and mounted on a frame in two bearing supports disposed at the rotor ends with steel holders made of a magnetic material, accommodating reels wound with wire. The reel holders are disposed in a cavity of the rotor and installed in bearing supports. Mounted near the reel holders are devices for restraining the reel holders from rotating together with the rotor which are in the form of electromagnets fixedly installed on the frame.

The restraining of the reel holders by a magnetic field make it possible to bring the center of gravity of each of the holders in coincidence with a geometric axis of the rotor and thus, prevent breakdowns in the machines employing a gravitational restraining of the reel holders, caused by jamming of the bearing of one of said reel holders and by capturing of the latter by the rotating rotor.

In addition, the magnetic restraining of the reel holders makes it possible to install the rotors vertically which has brought about a reduction in the production floor areas occupied by such equipment, a decrease in the zone or area attended by an operator and thus an increase in labor productivity.

However, in spite of these advantages, such machines still have large overall dimensions because of the rotor design, inasmuch as the rotor length is not reduced when compared with rotors of the machines employing the gravitational restraining of reel holders which for the most part complicates the vertical arrangement of a machine. Besides, the rotor of such machines is made in the form of a hollow cylindrical body featuring a substantial mass.

SUMMARY OF THE INVENTION

It is an object of the present invention to provide a wire stranding machine having a rotor of a small mass.

It is another object of the present invention to reduce the overall dimensions of a machine.

These and other objects of the invention are attained in a wire stranding machine comprising a vertical rotor mounted on a stand and carrying reel holders made of a magnetic material and installed in bearing supports, and electromagnets restraining the reel holders from rotating together with the rotor are fixedly installed on the stand near the reel holders. The rotor is made in the form of a shaft installed in a bearing support and carries on its free ends casings with reel holders mounted therein, and it is provided with through ports made in it between the portions for attachment of the casings, to pass wires being twisted. Also, the the casings are provided with ports for installing reels into the reel holders and with guide dies secured therein for passing the wires being twisted.

The fact that the rotor is embodied in the form of a shaft with casings for reel holders secured on its ends made it possible to decrease the mass, moment of inertia and length of the rotor which, in its turn, brought about a substantial decrease in the dimensions of the entire machine and simplified the servicing thereof.

It is preferred to make the ports in the casings so that their width and height are substantially greater than the width and height of a pole piece of an electromagnet, and to have the width of the casing body between the ports substantially narrower than the width of the electromagnet pole piece. This ensures the reduction of a screening effect of the rotor casing due to the predominance of the conductivity of an air gap between the electromagnet pole piece and the reel holder over the conductivity between the electromagnet pole piece and the casing body intermediate the ports, i.e. the rotor casing does not prevent the passage of magnetic power lines from the pole pieces of the electromagnet through the reel holder, thereby ensuring the magnetic restraining of the reel holder.

Thus, the wire stranding machine of the invention has a small mass of the rotor, occupies a smaller production floor area and is simple in servicing.

BRIEF DESCRIPTION OF THE DRAWINGS

The invention will now be described in greater detail with reference to a specific embodiment thereof, taken in conjunction with the accompanying drawings, in which.

DESCRIPTION OF THE PREFERRED EMBODIMENTS

Figure 1:
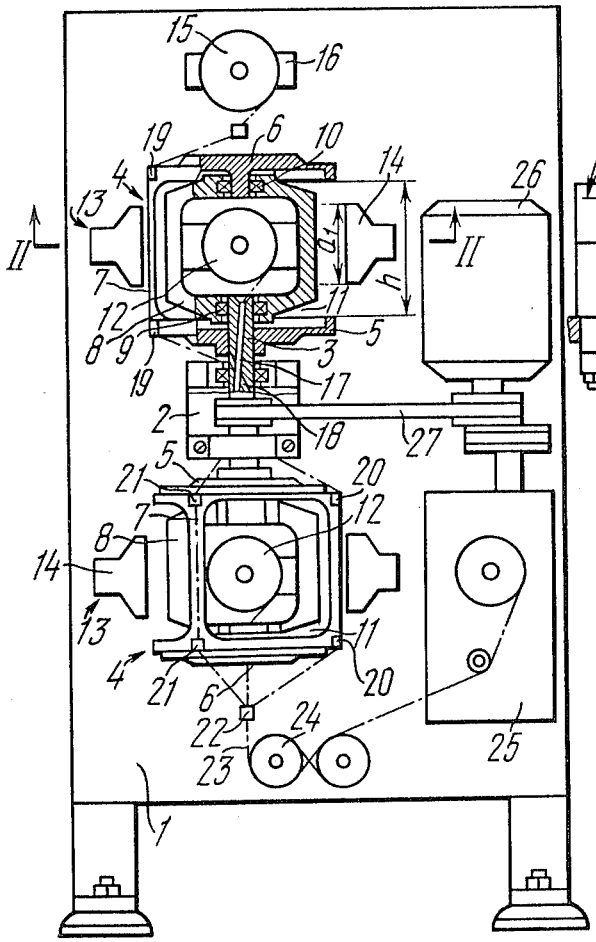
FIG. 1 is a front view, partly in section, illustrating diagrammatically a wire stranding machine.

A wire stranding machine comprises a stand 1 (FIG. 1) on which vertically mounted in a bearing support 2 is a rotor made in the form of a shaft 3, the shaft 3 being installed in the bearing support 2 by its middle portion. Arranged on the free ends of the shaft 3 are casings 4 which may also be made of a magnetic material. Each casing 4 is formed by a bottom 5, a cover 6 and a cylindrical shell 7 disposed between the bottom 5 and the cover 6. In the bottom 5 of each casing 4 is a through hole for passing the shaft 3, and the bottom 5 of the casing 4 is fixedly secured on the shaft 3. The casings 4 accommodate solid reel holders 8 of any known design, installed in bearing supports 9 disposed at the ends of the shaft 3. Additional bearing supports 10 for the reel holders 8 are installed in the covers 6 of the casings 4.

In the cylindrical shells 7 of the casings 4 are ports 11 (FIGS. 1 and 2), for example, three ports disposed with a pitch, for example, of 120° and intended for installing reels 12 into the reel holders 8.

Figure 2:
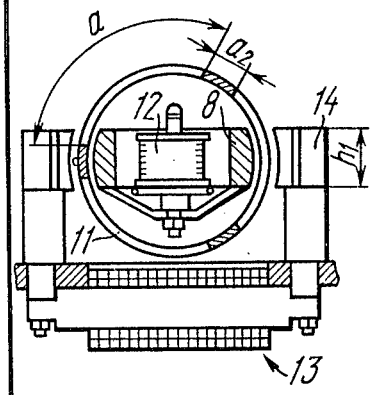
FIG. 2 is a sectional view taken on line II—II of FIG. 1.

As best shown in FIG. 2, electromagnets 13 are fixedly and encompass the reel holders 8 on opposite sides, and their magnetic fields restrain the reel holders 8 from rotating together with the shaft 3.

If the casings 4 are made of a magnetic material a width a of the port 11, shown in FIG. 2 along the arc, and its height h (FIG. 1) should be selected so that they are substantially greater, for example, two times greater than a width $a_1$ (FIG. 1) and a height $h_1$ (FIG. 2) of a pole piece 14 of the electromagnet 13. A width $a_2$ (FIG. 2) of the casing body, i.e. of the cylindrical shell 7, between the ports 11 should be substantially narrower, for example, three times narrower than the width $a_1$ (FIG. 1) of the pole piece 14 of the electromagnet 13.

When a strand is formed, for example, of three wires, two reels 12 are installed in the reel holders 8 and a third reel 15 is installed in a reel holder 16 fixedly secured on the stand 1 at its top portion, as is shown in FIG. 1.

In the a body of the shaft 3 between the positions thereof accommodating the casings 4 are through ducts 17 and 18 for passing wires unwound from the reels 12 and 15 respectively. Arranged on the casing 4 disposed at the upper end of the shaft 3 are guide dies 19 intended for passing the wire unwound from the reel 15.

Secured on the casing 4 disposed at the lower end of the shaft 3 are similar guide dies 20 and 21. The guide dies 20 as intended for passing the wire unwound from the reel 15 and running same through the guide dies 19 and the duct 18, whereas the guide dies 21 are designed for passing the wire unwound from the reel 12 and running same through the duct 17.

Arranged under the casing 4 disposed at the lower end of the shaft coaxially with the axis of rotation of the shaft 3 is a fixed die 22 which receives all the wires to be twisted and in which a strand 23 is formed from these wires. From the die 22, the strand 23 passes into a take-off and straightening mechanism 24, wherefrom it runs into a receiving mechanism 25. Any known mechanisms mounted on the stand 1 may be used as the mechanisms 24 and 25. An electric motor 26 and a belt drive 27 are used for rotating the shaft 3.

Any known electric circuit may be used for supplying the electromagnets 13.

The wire stranding machine of the invention operates in the following way.

The reels 12 and 15 wound with wire are installed into each reel holder 8 and 16 respectively, then these wires are threaded into the die 22. In this case the wire from the reel 15 passes through the guide dies 19, the duct 18 and the guide dies 20. The wire from the reel 12 disposed in the casing at the upper end of the shaft 3 passes through the duct 17 and the guide dies 21, whereas the wire from the reel 12 disposed in the casing at the lower end of the shaft 3 passes through a hole in the cover 6 of the casing 4.

Then, the electric motor 26 is switched on and the shaft 3 is rotated through the belt drive 27. The reel holders 8 with the reels 12 are restrained from rotating together with the shaft 3 and the casings 4 by the magnetic field of the electromagnet 13. From the die 22 the strand 23 twisted from the wires passes into the take-off and straightening mechanism 24, wherefrom it runs to the receiving mechanism 25.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A wire stranding machine for the manufacture of metal cord strands or steel ropes from wire wound on reels comprising: a stand, a rotor vertically installed on said stand in the form of a shaft; a bearing support disposed on said stand; said rotor being installed in said bearing support about its middle portion so that the ends thereof project from said bearing support; casings secured on the ends of said rotor; bearing supports installed in said casings; reel holders adapted for holding reels being mounted in said bearing supports of said casings and being made of a magnetic material; through ducts in said rotor between the portions thereof on which said casings are secured for passing twisted wires unwound from the reels; ports in each of said casings for enabling the reels to be installed into said reel holders; guide dies secured on each said casing for passing wires being twisted; and electromagnets fixedly installed on said stand near said casings for restraining said reel holders from rotating together with said rotor and casings.

2. A wire stranding machine according to claim 1, wherein said electromagnet is provided with a pole piece; each said port of the casing is made so that its width and height are substantially greater than the width and height of a pole piece of said electromagnet; and the width of a body of said casing between said ports is substantially narrower than the width of the pole piece of said electromagnet.

* * * * *